US011975378B2

(12) United States Patent
Campeotto

(10) Patent No.: US 11,975,378 B2
(45) Date of Patent: May 7, 2024

(54) MACHINE AND METHOD FOR THE WORKING OF TUBES

(71) Applicant: SMI S.R.L.—SISTEMI MECCANICI INDUSTRIALI, Varmo (IT)

(72) Inventor: Sergio Campeotto, Teor (IT)

(73) Assignee: SMI S.R.L.—Sistemi Meccanici Industriali, Varmo (IT)

( * ) Notice: Subject to any disclaimer, the term of this patent is extended or adjusted under 35 U.S.C. 154(b) by 0 days.

(21) Appl. No.: 17/995,144

(22) PCT Filed: Mar. 23, 2021

(86) PCT No.: PCT/IT2021/050076

§ 371 (c)(1),
(2) Date: Sep. 30, 2022

(87) PCT Pub. No.: WO2021/199088

PCT Pub. Date: Oct. 7, 2021

(65) Prior Publication Data

US 2023/0150005 A1 May 18, 2023

(30) Foreign Application Priority Data

Mar. 31, 2020 (IT) ..... 202000006778

(51) Int. Cl.

| | |
|---|---|
| ***B21D 35/00*** | (2006.01) |
| ***B21D 43/00*** | (2006.01) |
| ***B21D 43/28*** | (2006.01) |
| ***B21D 53/06*** | (2006.01) |

(52) U.S. Cl.
CPC ..... *B21D 35/003* (2013.01); *B21D 43/006* (2013.01); *B21D 43/28* (2013.01); *B21D 53/06* (2013.01)

(58) Field of Classification Search
CPC ..... B21D 43/006; B21D 43/28; B21D 43/06
See application file for complete search history.

(56) References Cited

U.S. PATENT DOCUMENTS

| | | | | |
|---|---|---|---|---|
| 3,922,901 A | | 12/1975 | Hillegas et al. | |
| 4,584,751 A | * | 4/1986 | Gray | B21D 53/085 29/523 |
| 4,584,765 A | * | 4/1986 | Gray | B23P 19/022 29/523 |
| 4,589,198 A | * | 5/1986 | Greever | B23P 19/022 29/709 |

(Continued)

FOREIGN PATENT DOCUMENTS

CN 108672589 A 10/2018

OTHER PUBLICATIONS

International Search Report and Written Opinion for International Patent Application No. PCT/IT2021/050076, mailed Jul. 6, 2021.

*Primary Examiner* — Jason L Vaughan
(74) *Attorney, Agent, or Firm* — Andrus Intellectual Property Law, LLP

(57) ABSTRACT

Machine for working tubes, in particular a hairpin bender machine for simultaneously working a plurality of tubes intended, in particular, to make heat exchangers, said machine comprising a device for feeding and moving tubes to be worked, a unit for bending said tubes, a cutting member configured to cut said plurality of tubes.

9 Claims, 3 Drawing Sheets

(56) References Cited

U.S. PATENT DOCUMENTS 4,734,969 A * 4/1988 Currier ..... B21D 53/085 29/890.047
4,761,866 A * 8/1988 Murphy ..... B21D 41/02 29/523
4,766,667 A * 8/1988 Gray ..... B21D 53/085 29/523
4,771,536 A * 9/1988 Vanderlaan ..... B21D 53/085 29/523
4,780,955 A * 11/1988 Stroup ..... B21D 53/085 29/523
4,815,185 A * 3/1989 Gray ..... B21C 37/24 29/523
4,839,950 A * 6/1989 Stroup ..... B21D 53/085 29/523
4,843,860 A * 7/1989 Gray ..... B21D 41/02 72/370.06
4,858,296 A 8/1989 Gray
4,858,305 A * 8/1989 Gray ..... B21D 53/085 29/523
5,033,190 A * 7/1991 Gray ..... B21D 53/085 29/523
5,127,155 A * 7/1992 Kendic ..... B21D 53/085 29/523
5,220,722 A * 6/1993 Milliman ..... B21D 53/085 29/726
5,233,853 A * 8/1993 Milliman ..... B21D 11/07 72/20.5
5,353,496 A * 10/1994 Harman ..... B21D 53/085 29/898.047
5,632,080 A * 5/1997 Harman ..... B23P 19/022 29/726.5
5,685,066 A * 11/1997 Mohrmann ..... B21D 53/085 29/726
5,901,596 A * 5/1999 Tetzloff ..... B21D 7/024 72/134
6,176,006 B1 * 1/2001 Milliman ..... B21D 53/085 29/726
8,033,018 B2 * 10/2011 Dees ..... B23P 15/26 228/183
8,074,356 B2 * 12/2011 Branyon ..... B23K 1/0012 29/523
2003/0115925 A1 6/2003 Harman et al.
2004/0250422 A1 * 12/2004 Ali ..... B23P 15/26 29/890.047
2011/0314675 A1 12/2011 Dees et al.
2013/0118224 A1 5/2013 Long

* cited by examiner

MACHINE AND METHOD FOR THE WORKING OF TUBES

CROSS-REFERENCE TO RELATED APPLICATIONS

This application is the U.S. national stage application of International Application PCT/IT2021/050076, filed Mar. 23, 2021, which international application was published on Oct. 7, 2021, as International Publication WO 2021/199089 in the English language. The international application is incorporated herein by reference, in entirety. The international application claims priority to IT Patent Application No. 202000006778, filed Mar. 31, 2020, which is incorporated herein by reference, in entirety.

FIELD OF THE INVENTION

The present invention concerns a machine for working tubes, in particular a hairpin bender machine for bending tubes intended, in particular, for making heat exchangers.

BACKGROUND OF THE INVENTION

Finned heat exchangers are known, used in a wide variety of uses, such as small heat exchangers used in the automotive sector, or large heat exchangers used in machines for air conditioning or industrial refrigeration.

Heat exchangers generally consist of a finned pack passed through by one or more banks of overlapping tubes in which the heat exchange fluid circulates.

The tubes are connected in series, or in parallel, in their terminal parts, to create a circuit which typically provides to invert the flow by 180°.

For reasons of manufacturing convenience, that is, to eliminate brazing at least at one end of the tube, instead of mounting them in pairs in parallel with each other, the tubes are bent in a U shape with the arms parallel, to produce the so-called hairpins.

The hairpins are commonly produced with hairpin bender machines, which comprise at least means to feed the tubes to be worked and a bending unit suitable to bend the tubes by a desired angle.

One disadvantage of known hairpin bender machines is that they are not able to make hairpins longer than 4-5 meters.

Therefore, for larger finned packs, in which the length of the hairpins is not sufficient, straight tubes or segments of a greater length must be used, which are then connected to each other at 180° by unions or bends.

To allow the connection of the bends to the ends of the straight pipes, at least one of these ends must be subjected to a belling operation or process. The belling process creates a cup shape, that is, a flare, which allows to insert the small bend or unions inside it.

To make said segments, it is known to use specific tube cutting machines, which work one tube or more at a time, to straighten and cut the tube to the desired length and to make said flared end.

Therefore, in order to create straight tubes with a flared end and hairpins, it is necessary to use respective and different machines, each suitable to perform one process or the other.

Therefore, a production plant for tubes for heat exchangers of any size must be equipped with both tube cutting machines and also hairpin bender machines, which implies an investment both in terms of money and also in terms of considerable space.

There is therefore a need to perfect a machine for working tubes which can overcome at least one of the disadvantages of the state of the art.

In particular, one purpose of the present invention is to provide a machine for working tubes which allows to increase productivity while reducing the overall sizes compared with known machines of this type.

Another purpose of the present invention is to provide a flexible machine, that is, one which can be easily adaptable to the different work and production requirements.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes, there is provided a machine for working tubes, in particular a hairpin bender machine, configured to simultaneously work a plurality of tubes intended to make heat exchangers.

The machine comprises:

- a feed and movement device configured to simultaneously feed and move a plurality of tubes to be worked,
- a bending unit suitable to carry out bending operations on the plurality of tubes,
- a cutting member configured to cut the plurality of tubes.

According to one aspect of the invention, the machine also comprises a belling device to perform, alternatively to a bending operation, a belling operation on at least part of the plurality of tubes.

In this way, a double-use hairpin bender machine is obtained which allows to alternate, according to requirements, either a work of bending the plurality of tubes in order to obtain a corresponding plurality of hairpins, or a belling operation in order to obtain, simultaneously, a plurality of straight belled tubes, that is, with at least one of their ends being flared.

Therefore, contrary to what is known, with the overall sizes and management costs of a single machine it is possible to produce two different types of tubes for heat exchangers, also on the basis of the length required.

Another advantage is that the possibility of working several tubes at the same time offers evident productivity advantages, especially as regards the belling workings which, with the state of the art, can be carried out only on individual tubes.

The invention also describes a method to bell a plurality of tubes with a hairpin bender machine, the method comprising:

- feeding a plurality of tubes to be worked on a plurality of feeding tracks defined by guides, and
- moving the plurality of tubes toward a bending unit and a cutting member of the hairpin bender machine,
- performing at least cutting operations on the plurality of tubes.

According to one aspect of the invention, the method also comprises:

- aligning with the tracks defined by guides for the tubes belling elements of a belling device, and associating the plurality of tubes with the belling elements to perform a belling operation.

BRIEF DESCRIPTION OF THE DRAWINGS

These and other aspects, characteristics and advantages of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

We will now refer in detail to the possible embodiments of the invention, of which one or more examples are shown in the attached drawings. Each example is supplied as a non-limiting example of the invention. For example, one or more characteristics shown or described insomuch as they are part of one embodiment can be varied or adopted on, or in association with, other embodiments to produce another embodiment. It is understood that the present invention shall include all such possible modifications and variants.

Figure 1:
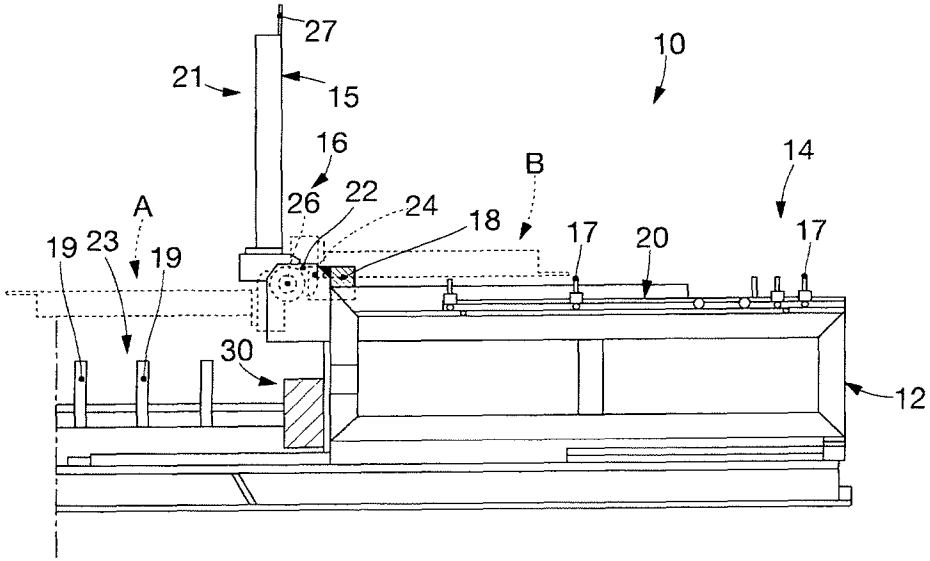
FIG. 1 is a lateral view of a machine for working tubes in accordance with some embodiments described here.

With reference to FIG. 1, a machine 10 for working tubes is described, in particular, a hairpin bender machine for simultaneously working and bending a plurality of tubes intended, in particular, to make heat exchangers.

The machine 10 comprises a base 12, such as for example a metal bearing structure, on which its main components at least partly rest and/or are installed, including:

- a device 14 for feeding and moving tubes to be worked,
- a bending unit 16 suitable to carry out bending operations on the plurality of tubes,
- a cutting member 18 configured to cut the plurality of tubes.

The tubes to be worked can be positioned in a feed magazine or slider, not shown, where they can be disposed, for example, in a plurality of coils able to be unwound.

The feed and movement device 14 can be configured to provide to unwind the coils and consequently to straighten the tubes for introduction into the machine 10.

Figure 3C:
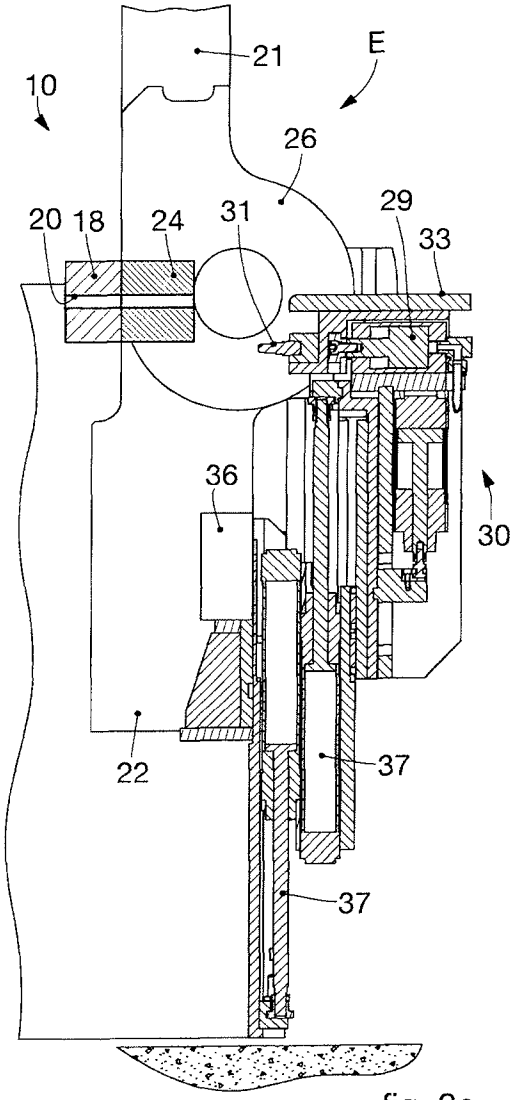
FIGS. 3*a*, 3*b* and 3*c* are lateral section views along line III of FIG. 2.
Figure 3B:
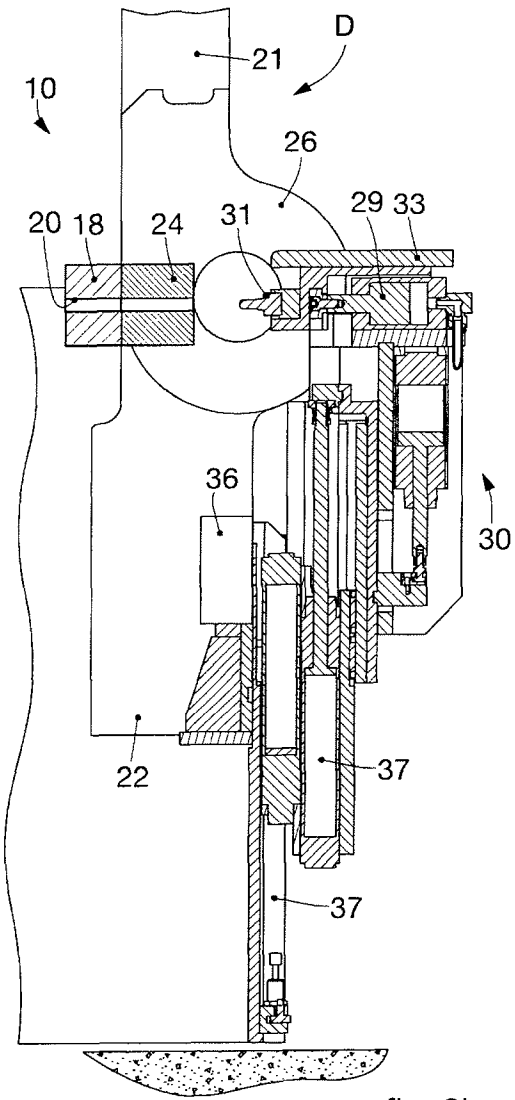
Figure 3A:
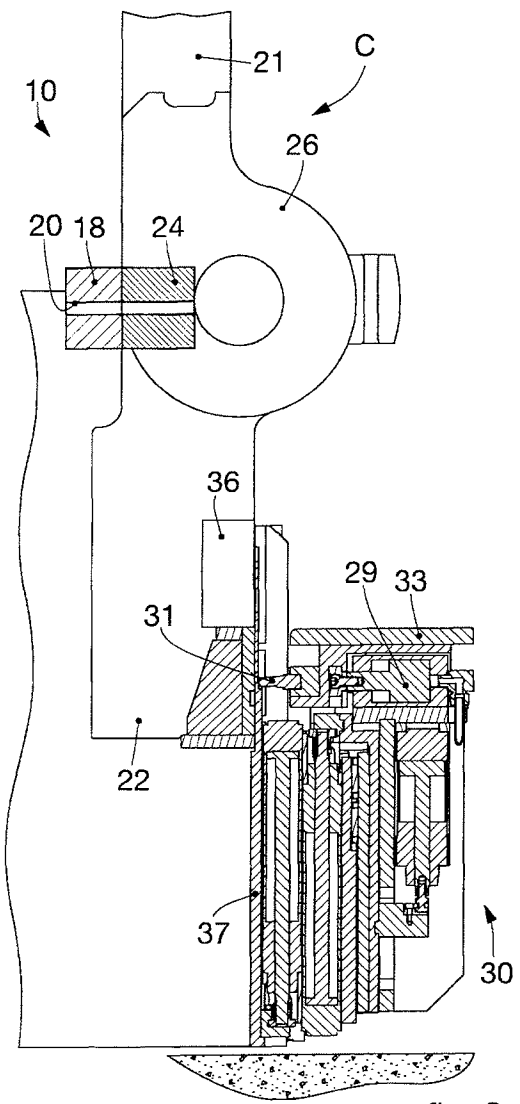

The feed and movement device 14 can comprise a plurality of guides 20 which define feed tracks which develop substantially parallel to each other and form a rectilinear path to guide the plurality of tubes up to the bending unit 16 (FIGS. 3*a*, 3*b* and 3*c*).

The feed and movement device 14 also comprises one or more engagement elements 17 configured to engage the plurality of tubes and to move them along the plurality of guides 20.

The engagement elements 17 can also provide to remove the plurality of tubes from the machine 10, for example after working, prior to cutting by means of the cutting member 18.

In other variants of the machine 10 there can be extraction members, not shown, separated from the feed and movement device 14, configured to remove the worked and cut tubes.

The removed tubes can be conveyed, substantially by gravity, onto movement members 19, for example mechanical arms and/or conveyor belts, in order to be taken to a collection zone 23 where they are deposited in a container or suchlike.

The feed and movement device 14 comprises at least one drive motor.

The bending unit 16 comprises a bending arm 21 mounted on a support structure 22, integral with the base 12.

The bending arm 21 can be replaced based on the length of the tubes to be bent and/or the number of tubes to be bent simultaneously.

The bending arm 21 can be installed on a central support 26 mounted rotatable on the support structure 22.

The bending arm 21 also comprises an operating surface 15 suitable to receive the plurality of tubes. The operating surface 15 can be provided with housings 27 for housing and retaining the tubes—also with suitable retention means—during the working operations.

The machine 10 also comprises a clamping unit, for example a group of clamps 24, the seatings of which are configured to cooperate with the tracks defined by the guides 20 in order to jointly engage the tubes, keeping them in the correct position during the working operations, for example during bending.

The seatings that are formed by the association between the group of clamps 24 and the tracks defined by the guides 20 can have different diameters, allowing to work tubes of different diameters.

In correspondence with the clamps 24 there are bending shapes which contribute to form the bend of the plurality of tubes during the bending step.

According to some embodiments, the group of clamps 24 is positioned in correspondence with the central support 26.

In order for it to move, that is, to rotate, the bending unit 16 is provided with at least one motor, for example a hydraulic motor, or an electric motor 28 advantageously of the brushless type.

The bending arm 21 can have at least two positions, a first starting position A and a second arrival position B.

In the first starting position A, the bending arm 21 is disposed with the operating surface 15 in substantial coplanarity with the guides 20, in such a way as to take respective housings 27 into alignment with the tracks defined by the guides 20 in order to house and retain the tubes.

The bending can take place with a movement of the bending arm 21 complementary to the bending angle that is to be obtained on the plurality of tubes, or a portion thereof.

The bending on the plurality of tubes, or a portion thereof, takes place in correspondence with a working zone 25 which is substantially downstream of the group of clamps 24.

A typical bend for tubes for heat exchangers consists of a bend of about 180°, corresponding to a movement of the bending arm 21 up to the second arrival position B in which the operating surface 15 is located above the tracks defined by the guides 20, substantially parallel to them.

According to one aspect of the invention, the machine 10 also comprises a belling device 30 to perform, alternatively to a bending operation, a belling operation on at least part of the plurality of tubes.

According to the invention, in fact, the machine 10 can be configured to alternate one or the other working, even during the same operating step, that is, alternate the use of the bending arm 21 or the belling device 30, for example according to the length of the tubes to be produced.

Figure 5:
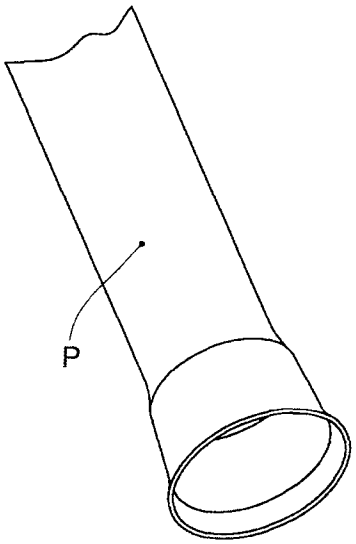
FIG. 5 shows one end of a tube after the belling operation has been performed.

For shorter lengths, the machine 10 can be equipped to produce hairpins, as indicated above, while for longer lengths the machine 10 will be set to exclude the bending unit and to activate the belling device 30 in order to produce straight belled tubes, that is, flared at one of their ends (FIG. 5).

With the same machine 10 it is therefore possible to carry out two different types of working, which can currently be achieved only by using different and separate machines.

The belling device 30 comprises belling elements 31, each suitable to be aligned with each of the tubes in order to cooperate with one of its ends.

In particular, each belling element 31 is suitable to be aligned with each of the tracks defined by guides 20 of the feed and movement device 14, in order to cooperate with one end of each tube of the plurality of tubes.

In accordance with some embodiments, the belling elements 31 can be disposed with a pattern which is complementary to the disposition of the tracks defined by guides 20.

By means of this solution, the machine 10 is able to simultaneously carry out a belling operation of up to eight tubes having lengths for which the execution of hairpins is not possible or in any case not recommended.

In other variants, the machine 10 can be configured to bell a number even greater than eight tubes simultaneously.

Figure 2:
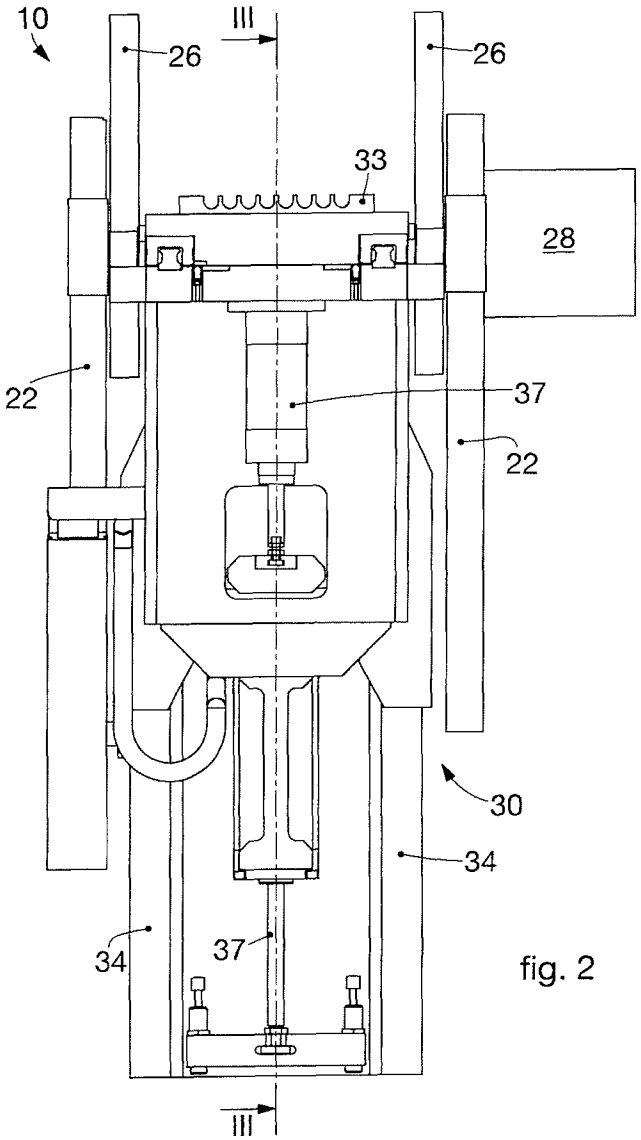
FIG. 2 is a front view of a machine for working tubes in accordance with some embodiments described here.

With reference to FIGS. 1 and 2, the belling device 30 is positioned downstream of the tracks defined by the guides 20, that is, in correspondence with the central support 26 onto which the bending arm 21 is mounted.

From FIG. 2 it is also possible to appreciate the small sizes of the belling device 30, which can be comprised inside the overall size of a conventional hairpin bender machine.

In this position, the belling device 30 can receive the end of the tubes at exit from the group of clamps 24 in order to work them while the group of clamps 24 keeps the plurality of tubes in position.

In other variants, the belling device 30 comprises its own group of clamps to retain the plurality of tubes during the belling work.

The belling device 30 can be attached on the base 12 or on the support structure 22.

According to one variant, not shown, the belling device 30 can possibly be attached onto a support structure independent from the base 12 and/or from the support structure 22.

However, in other variants of the machine 10, the belling device 30 can also be mounted in other parts of the machine, either in a mobile or fixed manner.

In accordance with some embodiments, the belling device 30 can cooperate with translation members 34, for example one or more sliders, which define a predetermined path on which the belling device 30 can move. Possibly, the one or more sliders 34 can be associated with a frame 32.

In some embodiments, the belling device 30 can be associated with drive devices 36, for example, an electric motor, which allow its movement.

The belling device 30 can also be associated with movement devices, for example one or more hydraulic or pneumatic cylinders 37, or belts or toothed wheels, etc. which, driven by the electric motor 36, allow it to be displaced.

With reference to FIGS. 3*a* and 3*b*, the belling device 30 can be configured to move at least from an inactive position C in which the belling device 30 is positioned at a lower level than the tracks defined by guides 20 (FIG. 3*a*), to a working position D in which the belling elements 31 of the belling device 30 are aligned with the tracks defined by guides 20 (FIG. 3*c*), and vice versa.

In particular, in the working position D, each belling element 31 is coaxial to the tracks defined by the guides 20.

According to one variant, the belling device 30 can comprise a movement member 29 for moving the belling elements 31 from an inactive position to a working position cooperating with one end of the tubes to be worked.

In order to perform the belling operation, the belling elements 31 are thrust by a movement member 29 and inserted into the end of the plurality of tubes in which the desired flaring is to be obtained.

During the belling operation, the plurality of tubes is advantageously engaged by the group of clamps 24.

Figure 4A:
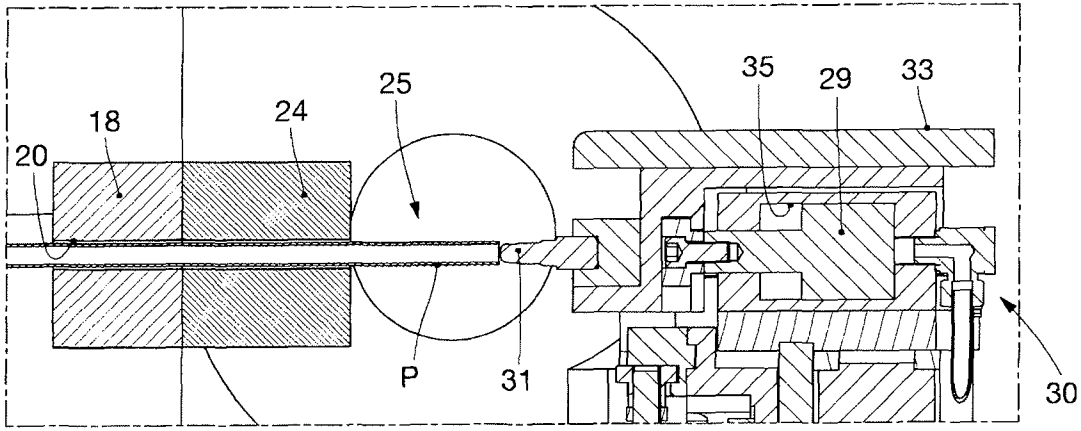
FIGS. 4*a* and 4*b* show two different steps of the belling operation.
Figure 4B:
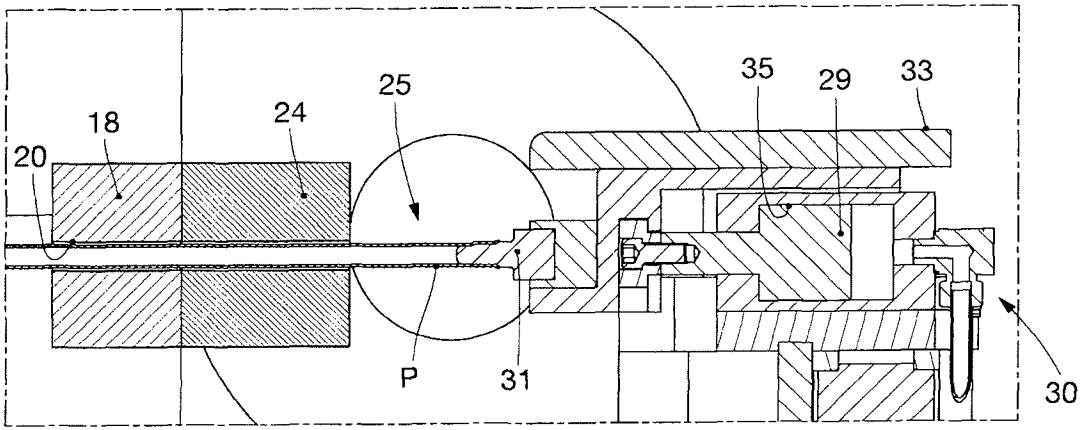

In FIG. 4*a*, the belling device 30 is in the working position D with corresponding belling elements 31 coaxial to a plurality of tubes P located cantilevered with respect to the group of clamps 24. In this case, the movement member 29 is retracted in a seating 35 thereof. The belling operation occurs by activating the movement member 29 which is made to move in the respective seating 35 causing each belling element 31 to be inserted into the end to be worked of each tube P of the plurality of tubes (FIG. 4*b*).

FIG. 5 shows what the end of a tube P worked by the belling device 30 described here looks like.

Advantageously, in the inactive position C, the belling device 30 can, for example, not interfere with other operations or workings, such as the bending ones.

In other embodiments, the working position D of the belling device 30 can also be provided with the bending arm 21 in the starting position A.

On the contrary, in the working position D the belling device 30 can be taken in correspondence with the working zone 25 in order to receive the plurality of tubes to be worked.

In fact, depending on the type of working chosen for the plurality of tubes, bending or belling, the machine 10 can be configured to alternate, respectively, the use of the bending arm 21 or of the belling device 30.

According to some embodiments, a respective arrival position B of the bending arm 21 can correspond to a working position D of the belling device 30.

Similarly, a respective starting position A of the bending arm 21 can correspond to an inactive position C of the belling device 30.

In the arrival position B, the bending arm 21 is positioned in such a way as to free the access to the working zone 25 in order to allow the belling device 30 to be disposed in the working position D with respective belling elements 31 aligned with the tracks defined by the guides 20 on which the tubes are disposed in order to receive them.

In FIGS. 1, 3*a* and 3*b*, access to the working zone 25 is obtained by positioning the bending arm 21 at 90° with respect to the starting position A.

In other variants, access to the working zone 25 can also be obtained in other positions between the starting position A and the arrival position B of the bending arm 21.

For example, the access can be obtained by moving the bending arm 21 with respect to the starting position A by 30°, 35°, 40°, 45°, 50°, 55°, 60°, 65°, 70°, 75°, 80°, 85°, 90°, 95°, 100°, 105° and so on up to the arrival position B.

With reference to FIG. 3*c*, the belling device 30 can also be positioned in a by-pass or discharge position E, which is between the inactive position C and the working position D.

The by-pass position E allows the belling device 30 to position, in axis with the tracks defined by the guides 20, a sliding plane 33 in order to supply a guide and a support to the plurality of tubes during their movement toward the collection zone 23.

The bending unit 16 and belling device 30 can be connected to a command and control unit, not shown, which manages the automatic or semi-automatic control of the various operating phases of the machine, for example, by commanding and controlling the motors 28 and 36 as well as the movement member 29.

The command and control unit can be programmed to control and manage the alternate positioning of the positions A-C and B-D of the bending arm 21 and of the belling device 30, as well as the by-pass position E.

The machine 10 thus configured can therefore be converted from the production of hairpins to the production of segments to be belled, and vice versa, without the need for complicated and long steps of disassembly and/or assembly of accessories or devices.

Therefore, the alternation from one type of working to another does not require the intervention of dedicated and specialized personnel and can be performed, for example, via the programming of the command and control unit in a few seconds.

The belling device 30 can be configured to move with respect to the tracks defined by the guides 20, preferably but not limited to, in a manner orthogonal thereto.

In other variants, in fact, the belling device 30 can be configured to move in a manner substantially parallel to the tracks defined by the guides 20.

In other embodiments, the machine 10 can be provided with the belling device 30 substantially fixed in one position. In this case, a system for raising and lowering the tracks defined by the guides 20 can be provided, in order to provide for the alignment of the latter with the belling elements 31.

The invention also describes a method to work a plurality of tubes with a multiple-use hairpin bender machine which comprises:

feeding the plurality of tubes to be worked on the tracks defined by the guides 20, and moving the plurality of tubes toward a bending unit 16 and a cutting member 18, performing at least cutting operations on the plurality of tubes.

According to one aspect of the invention, the method also comprises:

aligning with the tracks defined by the guides 20 belling elements 31 of the belling device 30, and associating the plurality of tubes with the belling elements 31 in order to perform a belling operation.

It is clear that modifications and/or additions of parts may be made to the machine for working tubes as described heretofore, without departing from the field and scope of the present invention as defined by the claims.

It is also clear that, although the present invention has been described with reference to some specific examples, a person of skill in the art shall certainly be able to achieve many other equivalent forms of machine for working tubes, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. A hairpin bender machine for simultaneously working a plurality of tubes, said machine comprising:

a device for feeding and moving tubes to be worked and comprising a plurality of guides which define feed tracks for said tubes, a unit for bending said tubes, a cutting member configured to cut said plurality of tubes, a belling device to perform, alternatively to a bending operation, a belling operation on at least part of said plurality of tubes, wherein said belling device comprises belling elements, each suitable to be aligned with each of said tubes to cooperate with one of its ends, wherein said belling device is associated with movement devices and is configured to have an inactive position, in which the belling elements are positioned at a lower level than said tracks defined by the guides, and a working position, in which said belling elements are aligned with said tracks defined by said guides.

2. The machine as in claim 1, wherein said belling device comprises a movement member for moving said belling elements from the inactive position to the working position cooperating with one end of said tubes.

3. The machine as in claim 1, wherein in said inactive position, said belling device does not interfere with the bending operations.

4. A method of working a plurality of tubes with a machine according to claim 1, the method comprising:

feeding said plurality of tubes to be worked on said tracks defined by said guides, and moving said plurality of tubes toward the unit for bending and the cutting member, performing at least cutting operations on said plurality of tubes, aligning with said tracks defined by said guides with the belling elements of the belling device, and associating said plurality of tubes with said belling elements to perform the belling operation.

5. The method as in claim 4, wherein said aligning comprises positioning said belling device from the inactive position in which the belling device is positioned at the lower level than said tracks defined by guides, to the working position in which said belling elements of said belling device are aligned with said tracks defined by guides.

6. The method as in claim 5, wherein before said aligning, positioning a bending arm of said bending unit in a position that does not interfere with said aligning.

7. The method as claimed in claim 4, wherein before said aligning, positioning a bending arm of said bending unit in a position that does not interfere with said aligning.

8. A hairpin bender machine for simultaneously working a plurality of tubes, said machine comprising:

a device for feeding and moving tubes to be worked, a unit for bending said tubes, a cutting member configured to cut said plurality of tubes, a belling device to perform, alternatively to a bending operation, a belling operation on at least part of said plurality of tubes, wherein said belling device is associated with movement devices; and wherein the feed device comprises a plurality of guides which define feed tracks for said tubes, and wherein said belling device has an inactive position in which the belling elements are positioned at a lower level than said tracks defined by the guides, and a working position in which said belling elements are aligned with said tracks defined by said guides.

9. The machine according to claim 8, wherein in said inactive position, said belling device does not interfere with the bending operations.

* * * * *